United States Patent [19]

Corbett et al.

[11] Patent Number: 5,035,276

[45] Date of Patent: Jul. 30, 1991

[54] EVAPORABLE FOAM PATTERN ASSEMBLY FOR CASTING A HOUSING FOR A ROTARY ENGINE

[75] Inventors: William D. Corbett; Benjamin L. Sheaffer, both of Fond du Lac, Wis.

[73] Assignee: Brunswick Corporation, Skokie, Ill.

[21] Appl. No.: 404,746

[22] Filed: Sep. 8, 1989

[51] Int. Cl.[5] ..... B22C 7/02; B22C 9/04

[52] U.S. Cl. ..... 164/34; 164/246; 164/249

[58] Field of Search ..... 164/235, 246, 249, 34, 164/35, 36, 45

[56] References Cited

U.S. PATENT DOCUMENTS

| | | | |
|---|---|---|---|
| 971,832 | 10/1910 | Connell | 164/91 |
| 3,745,854 | 7/1973 | Haag | 164/98 |
| 3,830,598 | 8/1974 | Ruf | 164/113 |
| 4,632,109 | 12/1986 | Osborn et al. | 164/45 |
| 4,640,333 | 2/1987 | Martin et al. | 164/246 |
| 4,657,063 | 4/1987 | Morris | 164/45 |
| 4,777,997 | 10/1988 | Corbett | 164/246 |
| 4,802,447 | 1/1989 | Corbett | 164/45 |

FOREIGN PATENT DOCUMENTS

| | | | |
|---|---|---|---|
| 62-282744 | 12/1987 | Japan | 164/34 |
| 62-282746 | 12/1987 | Japan | 164/45 |
| 62-282763 | 12/1987 | Japan | 164/34 |

OTHER PUBLICATIONS

"Evaporative Foam Casting Technology II Program", Nov. 1986.

*Primary Examiner*—Richard K. Seidel
*Assistant Examiner*—Rex E. Pelto
*Attorney, Agent, or Firm*—Andrus, Sceales, Starke & Sawall

[57] ABSTRACT

An evaporable foam pattern assembly for casting a housing for a rotary engine. The pattern assembly includes a central rotor chamber pattern section and a pair of end pattern sections which, in the cast engine, are mounted on either side of the central section. The cental pattern section is provided with a central chamber of epitrochoidal shape and the end sections are each formed with a central opening. The outer portion of each central opening is cylindrical in shape, while the inner portion is elliptical and separated from the outer portion by a relief groove. Each end pattern section is provided with an air passage that communicates through the relief groove with the elliptical opening, so that in the assembled cast engine, air introduced into the passage of one of the end sections flows into the rotor chamber of the central section and is discharged from the other end section. The central pattern section is formed of two compounds which are joined along a parting line disposed normal to the axis of the rotor chamber, while each end outer pattern section is formed of two components joined along a parting line that extends through the relief groove and is disposed normal to the axis of the openings in the end section.

27 Claims, 6 Drawing Sheets

EVAPORABLE FOAM PATTERN ASSEMBLY FOR CASTING A HOUSING FOR A ROTARY ENGINE

BACKGROUND OF THE INVENTION

A typical rotary engine is composed of three separate metal castings including a central casting that defines an epitrochoidal rotor chamber and a pair of end castings which are mounted on either side of the central casting. Both the central and end castings normally include water cooling passages with the water passages in the three castings being interconnected. In addition, the rotary engine can also include air passages, in which air is introduced into one of the end castings, flows through the rotor chamber of the central casting, and is discharged from the opposite end casting.

It is difficult using conventional sand casting techniques to cast the thin sections for the internal cooling cavities that are required in the rotory engine. Consequently it has been necessary to use core wires and core supports, when producing these sections by sand casting. The core wires must be removed after casting and the use of core supports results in holes being formed in the cast sections, which must be subsequently plugged.

In addition, with sand casting techniques dowel holes and bolt holes cannot be produced in the metal castings, so that these holes must be subsequently drilled in the cast parts. Further, water inlet and outlet openings are not produced in the metal casting and also must be subsequently drilled.

SUMMARY OF THE INVENTION

The invention is directed to an evaporable foam pattern assembly for casting a housing for a rotary engine. The assembly includes a central rotor chamber pattern housing and a pair of end housing pattern sections, each of which is formed of an evaporable polymeric material, such as polystyrene, polymethylmethacrylate, or the like.

The central pattern section is provided with a central rotor chamber of epitrochoidal shape, while each end pattern section is formed with a central opening. The outer portion of each central opening is cylindrical, while the inner portion is elliptical and is separated from the cylindrical portion by a relief groove. Each end pattern section is provided with an air passage that communicates through the relief groove with the elliptical portion of the opening, so that in the assembled cast engine air flows into the air passage of one of the end sections, passes through the rotor chamber of the central section and is discharged from the other of the end sections.

In addition, each of the pattern sections is provided with an internal water passage and in the assembled cast engine, cooling water is introduced into the water passage of the central section and flows around the exhaust passage in the rotor chamber, then flows downwardly into the water passage of the lower end section then back upwardly into a second water passage in the central section, and is discharged from the upper end section.

The central evaporable foam pattern section is formed of two main components which are joined by an adhesive along a parting line that is disposed normal to the axis of the rotor chamber. Each of the end pattern sections is also formed of two components, which are joined by an adhesive along a parting line that extends through the relief groove and is normal to the axis of the central opening in the respective end pattern section.

Each of the sections of the rotary engine is separately cast. In the casting procedure, the evaporable foam pattern is positioned in a mold and an unbonded flowable material, such as sand, is introduced into the mold and surrounds the pattern section, as well as filling the internal cavitites of the pattern section. A molten metal is then introduced into the mold and into contact with the pattern section via a sprue. The heat of the molten metal will vaporize the pattern section with the vapor being entrapped within the interstices of the surrounding sand, while the molten metal fills the void created by vaporization of the foam, to provide a cast part which conforms to the configuration of the pattern section.

With the use of the evaporable foam pattern section of the invention, thin wall sections and cavities can be produced in the casting process without the use of core supports, which are necessary in sand casting techniques. As a further advantage, dowel holes, bolt holes, and inlet and outlet ports for the cooling water passages can be cast into the sections thereby eliminating the necessity of drilling the holes in the cast metal part. In addition, no facing of the bosses which surround the bolt holes is necessary.

The parting lines between the components of the pattern sections are located such that the pattern sections can be readily assembled on high speed assembly lines and the pattern sections are designed so that the sand will readily fill all of the cavities in the pattern during the casting procedure.

In a conventional evaporable foam casting process, a ceramic wash is normally applied to all of the internal and external surfaces of the polymeric pattern prior to casting. The design of the pattern sections of the invention is such that the ceramic wash will readily contact all internal and external surfaces and will readily drain from the pattern sections after the pattern sections are removed from the wash tank.

Other object and advantages will appear in the course of the following description.

DESCRIPTION OF THE DRAWINGS

The drawings illustrate the best mode presently contemplated of carrying out the invention.

In the drawings.

DESCRIPTION OF THE ILLUSTRATED EMBODIMENT

Figure 1:
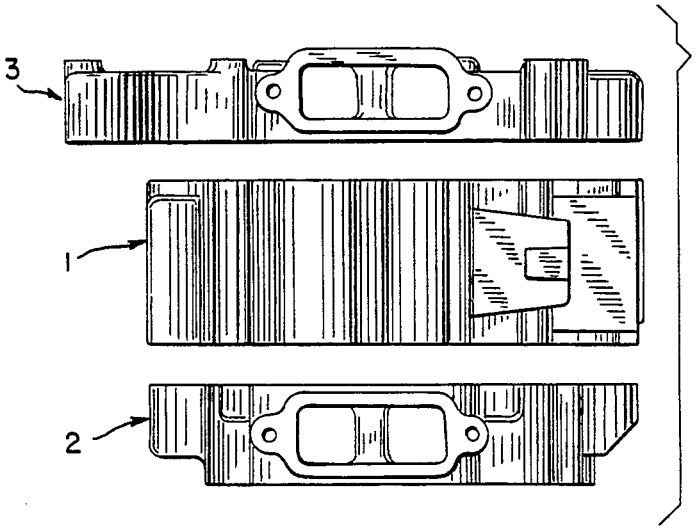
FIG. 1 is a side elevation of the pattern assembly of the invention.
Figure 6:
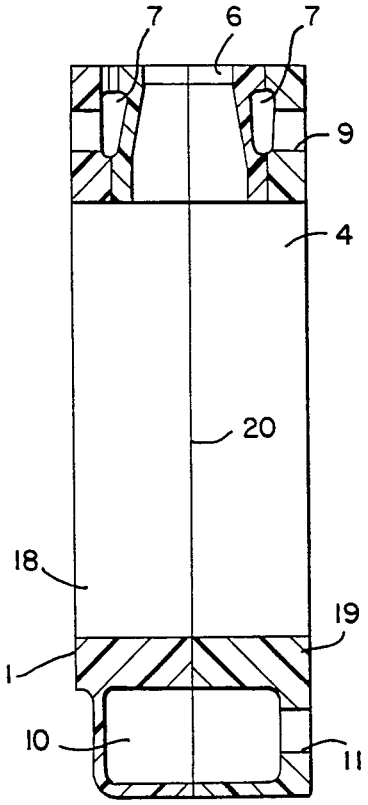
FIG. 6 is a section taken along line 6—6 of FIG. 2.
Figure 2:
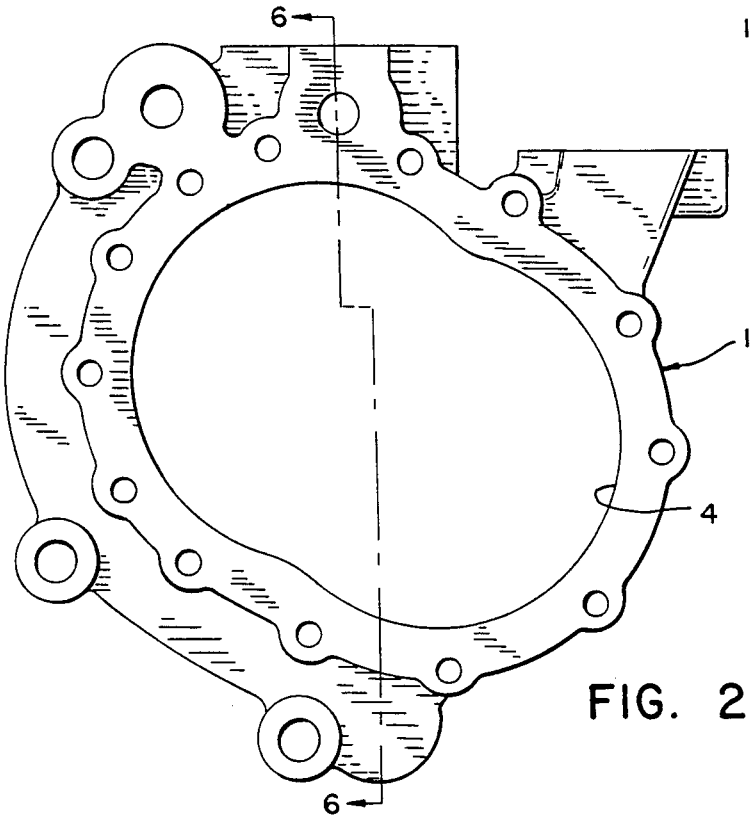
FIG. 2 is a top plan view of the central pattern section.

The drawings illustrate a pattern assembly for casting a metal housing of a rotary engine. The assembly includes a rotor housing pattern section 1, a lower end housing pattern section 2, and an upper end housing pattern section 3. The pattern sections are formed of an evaporable foam material, such as expanded polystyrene, polymethylmethacrylate, or other suitable material.

Each pattern section 1–3 is identical in configuration to the cast metal housing section and, therefore, the description of the pattern sections will be made in reference to the metal castings.

The central pattern section 1 includes a central rotor chamber 4 which is epitrochoidal in shape. In addition, pattern section 1 is provided with an inlet passage 5 that communicates with chamber 4 and in the cast engine serves as an inlet for the fuel mixture. Section 1 is also formed with an exhaust passage 6 through which the exhaust gases are discharged from the rotor chamber.

Figure 3:
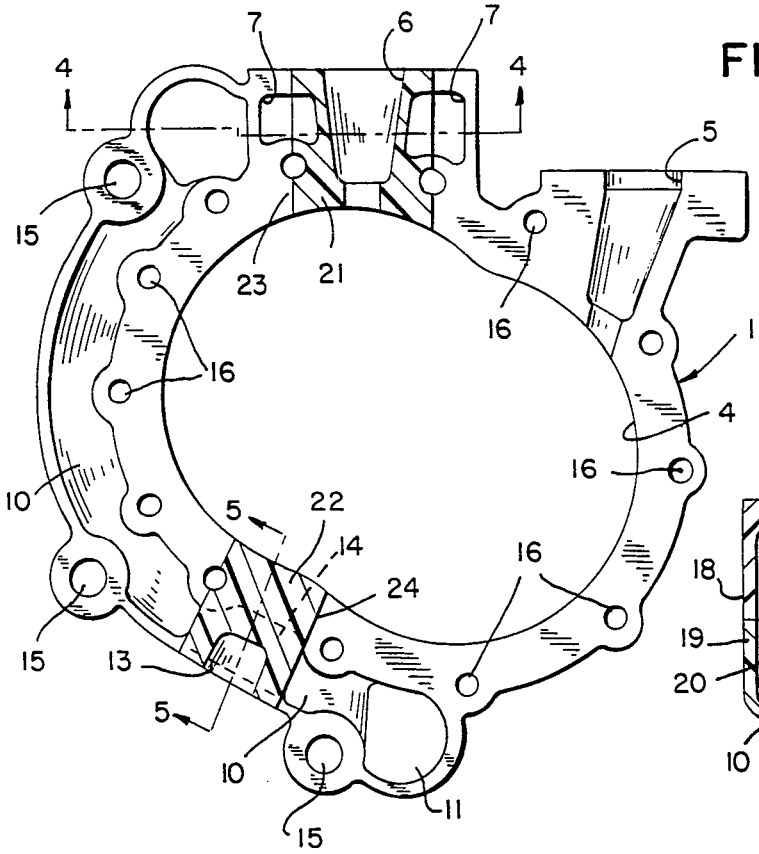
FIG. 3 is a transverse section of the central pattern section taken along the parting line between components of the pattern section.
Figure 4:
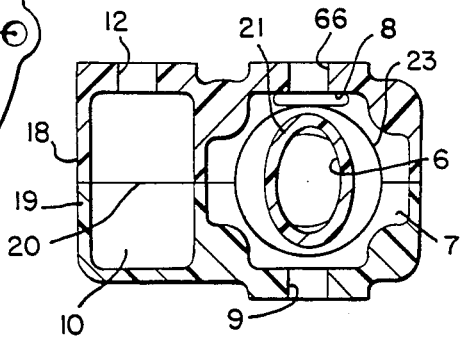
FIG. 4 is a section taken along lines 4—4 of FIG. 3.

As shown in FIGS. 3 and 4, a water chamber 7 surrounds exhaust passage 6 and in the assembled engine, water is introduced into chamber 7 through an inlet 8 and is discharged through an outlet 9 to the lower housing section 2 as seen in FIG. 4.

In addition, pattern section 1 is formed with an internal generally arcuate water passage 10 and an inlet 11 formed in one face of section 1 communicates with one end of passage 10, while an outlet 12 in the opposite face of the section communicates with the opposite end of passage 10. In the cast assembled engine, water from the lower housing section is fed to inlet 11 from the lower housing section 2, flows through passage 10 and is discharged through outlet 12 to the upper housing section 3.

Figure 5:
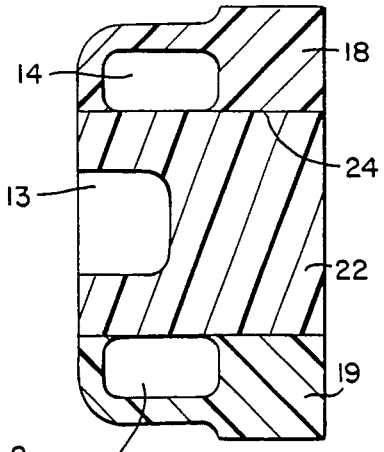
FIG. 5 is a section taken along lines 5—5 of FIG. 3.
Figure 7:
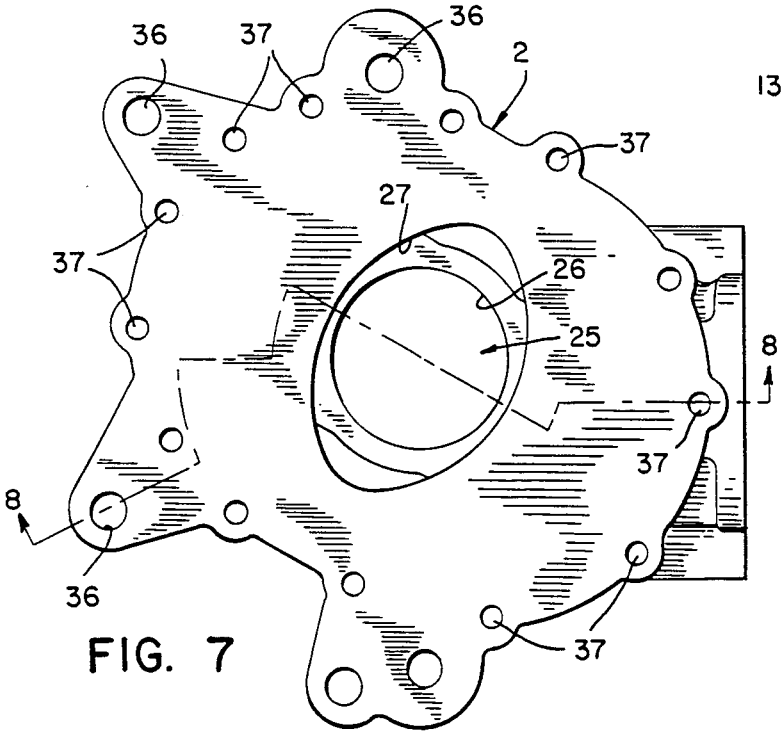
FIG. 7 is a top plan view of the bottom pattern housing section.

The periphery of pattern section 1 is formed with a depression or well 13, and in the cast engine a spark plug is mounted in the well. As best shown in FIG. 5, water passage 10 is divided into a pair of sections 14 which are disposed above and beneath the well 13, as illustrated in FIG. 5.

Rotor section 1 is formed with a plurality of dowel holes 15 and bolt holes 16. In the assembled cast engine, holes 15 receive dowel pins, while the holes 16 receive bolts to secure the cast sections together.

Pattern section 1 is composed of two main components 18 and 19 which are joined together by an adhesive along a parting line 20. Parting line 20 extends generally normal to the axis of the rotor chamber 4.

In addition, pattern section 1 includes a pair of generally cylindrical components 21 and 22 which are joined by an adhesive to components 18 and 19 along cylindrical parting lines 23 and 24, respectively. Component 21 defines exhaust passage 6 and is provided with a peripheral groove which mates with grooves in components 18 and 19 to define cooling chamber 7. Component 22 defines well 13.

The adhesive or glue employed to bond the sections 18, 19, 21 and 22 is a conventional type used in evaporable foam casting processes, and is capable of vaporizing when exposed to the heat of the molten metal, so that no glue residue remains in the metal casting.

The construction of the lower housing pattern section 2 is illustrated in FIG. 6–10. Pattern section 2 includes a central opening 25 which is composed of a lower cylindrical portion 26 and an upper elliptical portion 27, which is joined to the cylindrical portion 26 through relief grooves 28.

Figure 9:
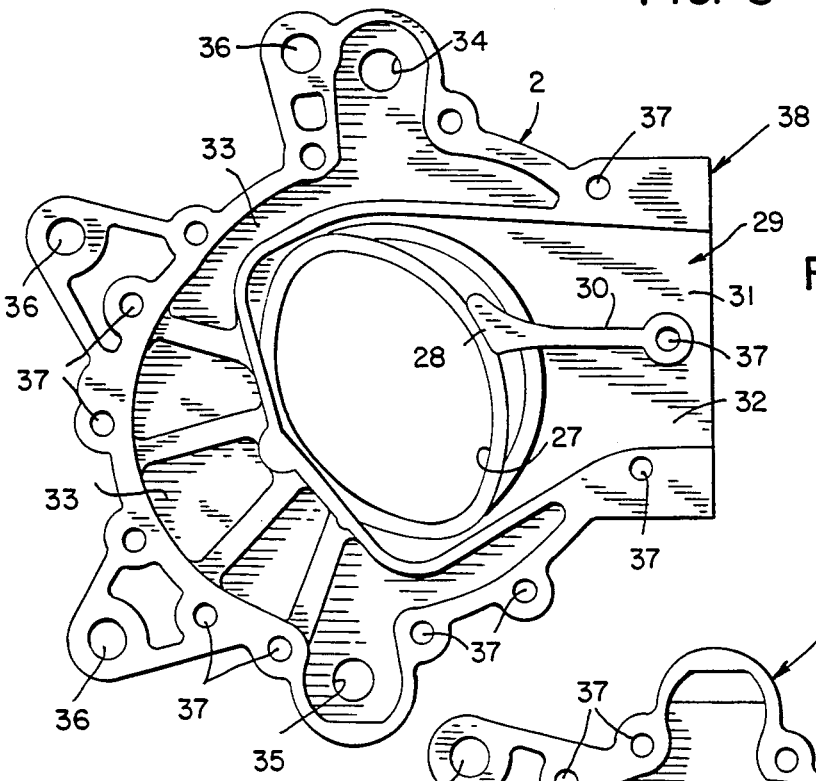
FIG. 9 is a section taken along line 9—9 of FIG. 8.
Figure 10:
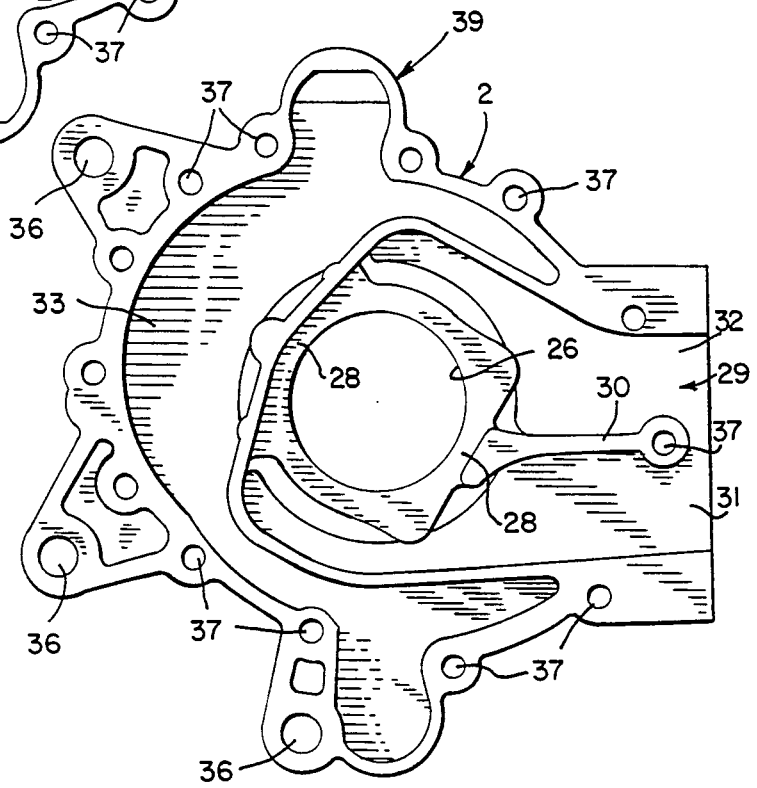
FIG. 10 is a section taken along line 10—10 of FIG. 8.
Figure 12:
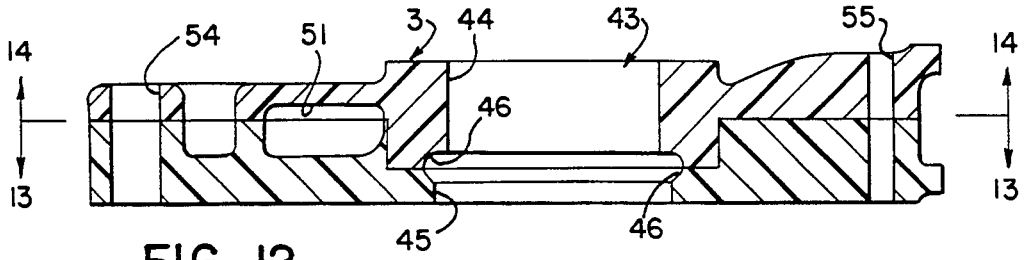
FIG. 12 is a section taken along line 12—12 of FIG. 11.
Figure 11:
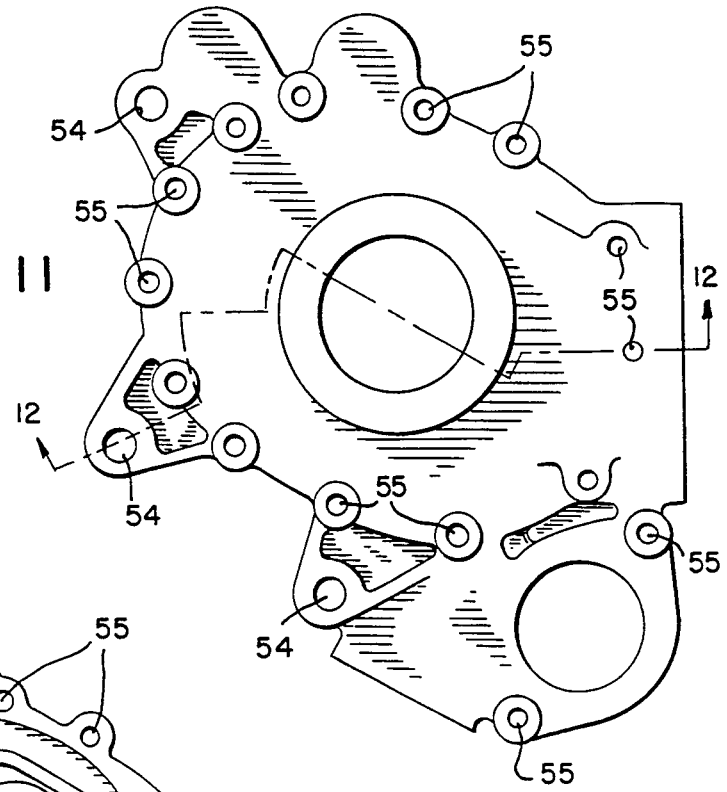
FIG. 11 is a top plan view of the upper housing pattern section.

As shown in FIGS. 9 and 10, pattern section 2 is also provided with a passage 29 which opens at the periphery of the pattern section. A central rib or divider 30 divides the passage 29 into a pair of air passage sections 31 and 32, which communicate with the elliptical portion 27 of opening 25.

In a single rotor engine, air is introduced into the upper section 3, flows downwardly through the rotor chamber 4 of central section 1, and is discharged through the passages 31 and 32 of lower section 2. The relief grooves 28 aid in increasing the volume of air that can be discharged from rotor chamber to the passages 31 and 32.

Lower pattern section 2 is also formed with a generally curved water passage 33 and one end of passage 33 communicates with an inlet opening 34. In the assembled cast engine inlet 34 communicates with outlet 9 of section 1, as seen in FIG. 9. In addition, an outlet opening 35 is connected to the opposite end of passage 34 and in the assembled cast engine outlet 35 is connected to inlet 11 of water passage 10 in central section 1.

Evaporable foam pattern section 2 is formed with a plurality of dowel holes 36 and a plurality of bolt holes 37. In the assembled cast engine, dowel holes 36 are aligned with dowel holes 15 in central section 1 and receive dowel pins, while bolt holes 37 are aligned with bolt holes 16 in section 1.

Figure 8:
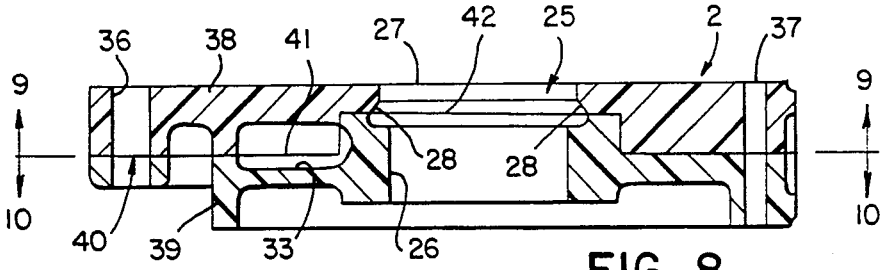
FIG. 8 is a section taken along line 8—8 of FIG. 7.

Lower section 2 is composed of a pair of components 38 and 39, which are joined together by an adhesive along parting line 40. As best shown in FIG. 8, parting line 40 is stepped, and includes an outer annular section 41 and an inner section 42. The inner section 42 of parting line 40 extends through the relief grooves 28.

The upper housing pattern section 3 is similar in construction to the lower section 2 and is illustrated in FIGS. 10–14. Section 3 includes a central opening 43 composed of an upper cylindrical portion 44 and a lower elliptical portion 45, which are joined by relief grooves 46.

An opening 47 connects elliptical portion 45 with the exterior and a central rib or divider 48 divides opening 47 into a pair of air inlet passages 49 and 50. Passages 49 and 50 communicate with the elliptical portion 45 of opening 43, and in the assembled single rotor engine, air is introduced into passages 49 and 50 and flows through elliptical portion 45 into rotor chamber 4 of section 1. The relief grooves 46 aid in increasing the volume of air that can be introduced through the elliptical portion 45 and into the rotor chamber.

Figure 13:
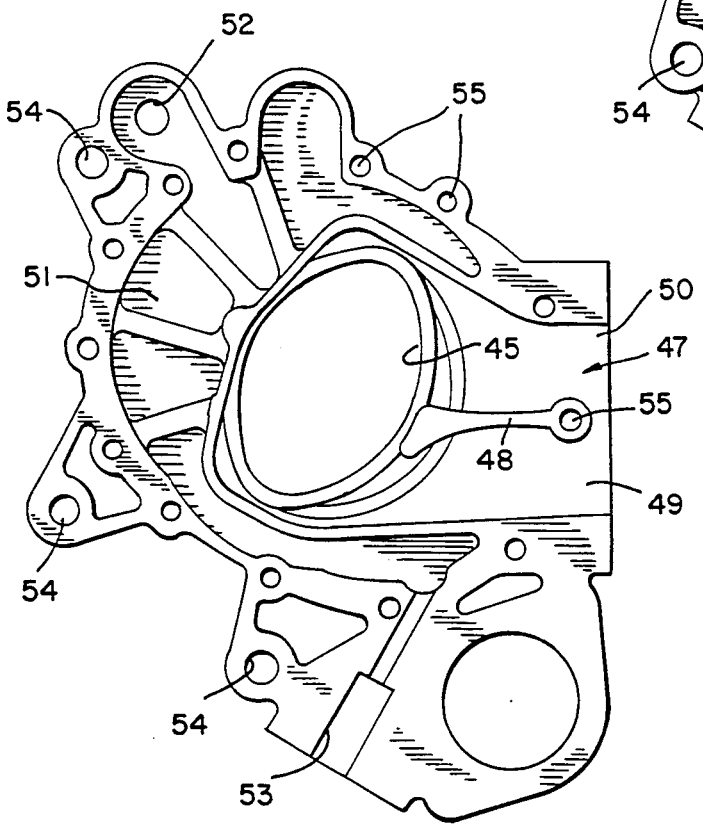
FIG. 13 is a section taken along line 13—13 of FIG. 12.
Figure 14:
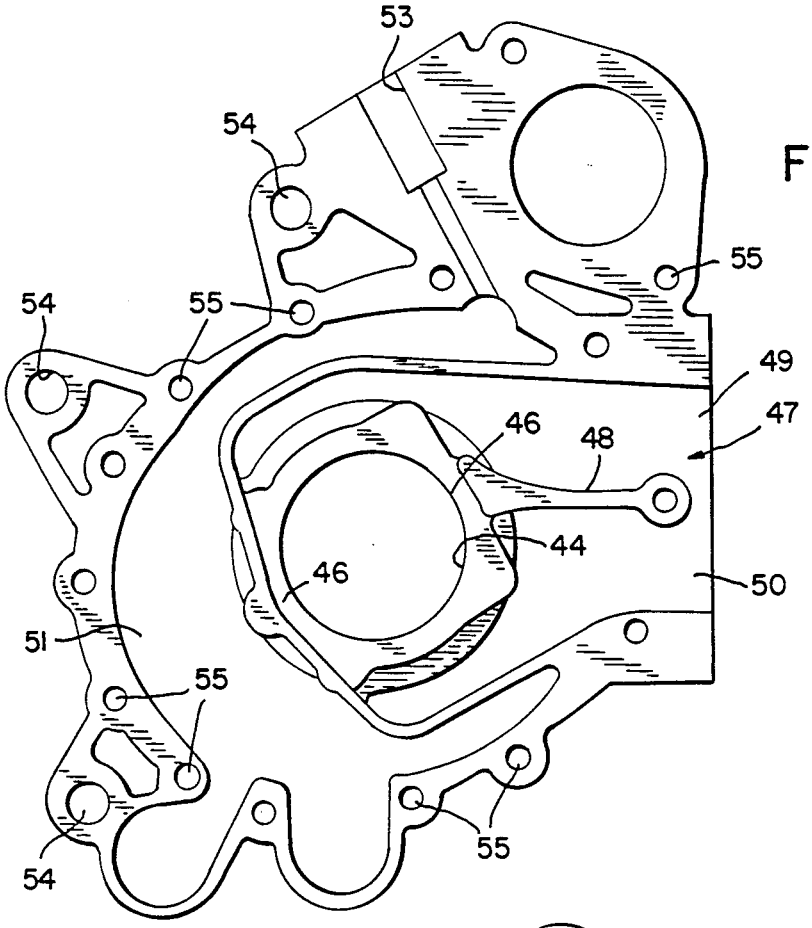
FIG. 14 is a section taken along line 14—14 of FIG. 12.

Upper section 3 is also provided with a generally curved water passage 51 and an inlet opening 52 formed in the bottom face of section 3 communicates with one end of water passage 51, while an outlet opening 53 extends from the opposite end of passage 51 to the periphery of section 3, as seen in FIG. 13. In the assembled cast engine, inlet opening 52 is in communication with outlet 12 of central section 1 and a thermostat is adapted to be mounted in the outlet 53.

In addition, pattern section 3 is formed with a plurality of dowel holes 54 and bolt holes 55. Dowel holes 54, in the assembled cast engine, are aligned with dowel holes 36 and 15, and receive dowel pins, while bolts holes 55 are aligned with bolt holes 37 and 16 and receive bolts to attached the cast metal housing sections together.

While FIGS. 1–14 illustrate a pattern assembly for casting a housing for a single rotary engine, a housing for a double rotor engine can be cast in a similar manner. The evaporable foam pattern assembly for casting a double rotor housing includes a pair of rotor housing sections 1, separated by a central pattern section 56, and end sections 2 and 3 are adapted to enclose the ends of the respective rotor sections 1.

Figure 16:
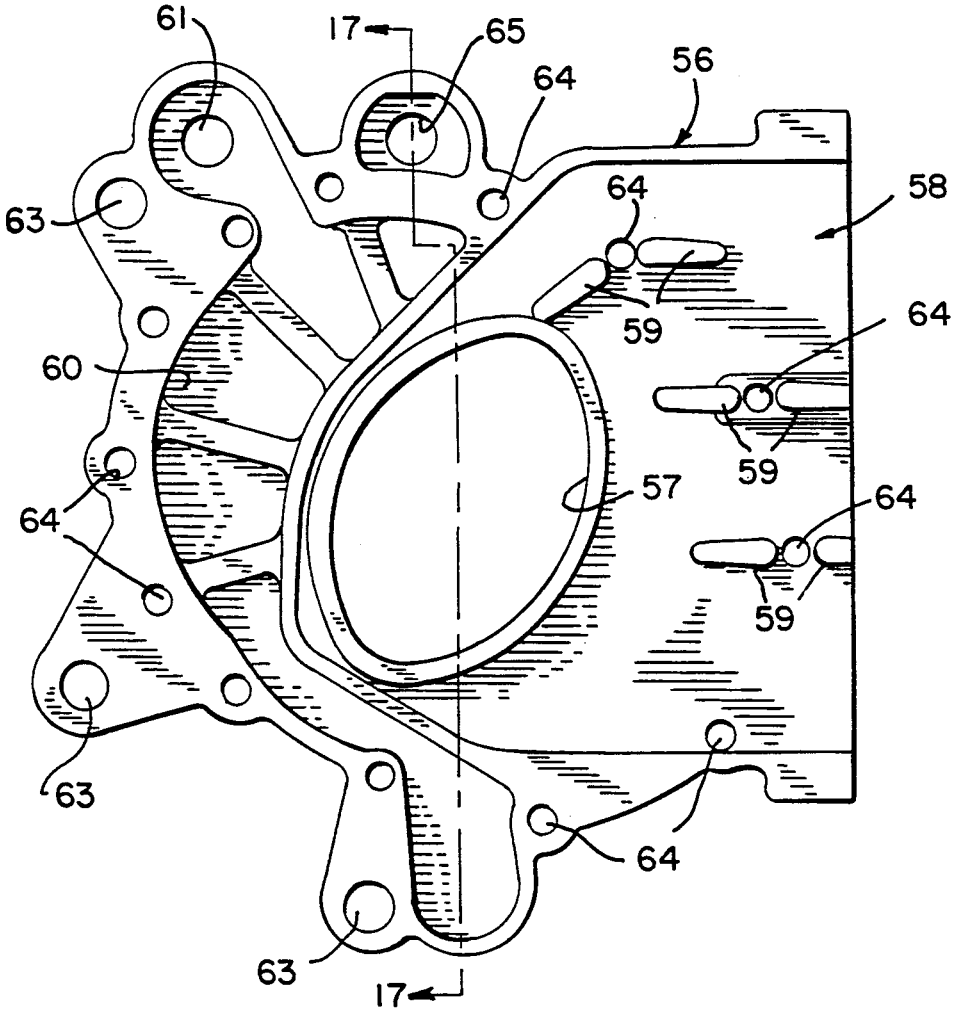
FIG. 16 is a transverse section of the center housing pattern section taken along the parting line.

The central pattern section 56, as used in a double rotor engine, includes a pair of central generally elliptical openings 57, which communicate with a central air passage 58, as seen in FIG. 16. A plurality of ribs 59 are disposed in passage 58 and serve to reinforce the metal casting, as well as dividing the air flow into several paths.

With the double rotor engine, air is introduced into both of the upper and lower housing sections 2 and 3, and flows through the respective rotor chambers 4, and is then discharged through openings 57 to passage 58 in central section 56.

Section 56 is also formed with an internal generally curved water passage 60 and water is introduced into passage 60 through an inlet opening 61 in one face of the section and is discharged through a water outlet opening 62 in the opposite face. Openings 61 and 62 communicate with water passages in the respective rotor section 1 in the two rotor engine.

Figure 15:
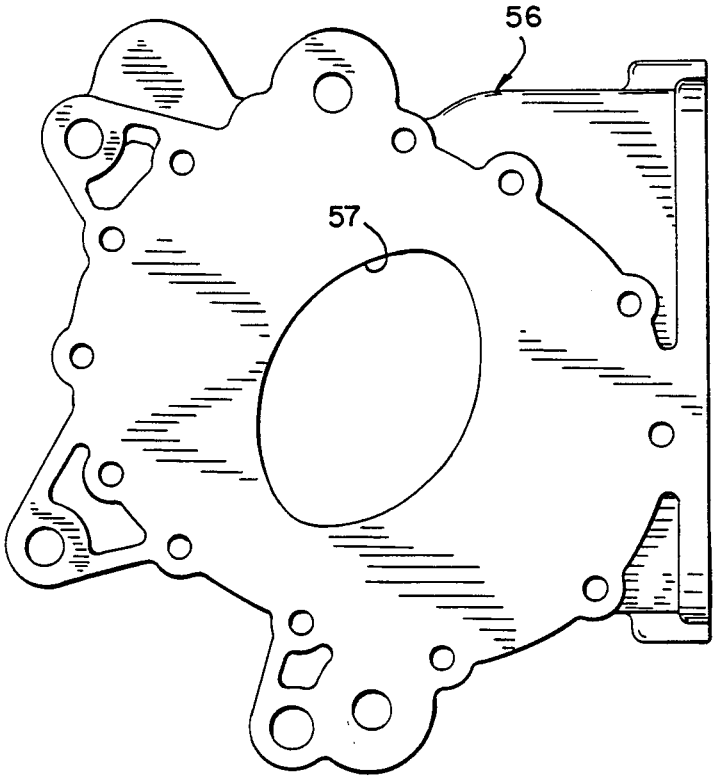
FIG. 15 is a plan view of center housing pattern section for a double rotor engine.

As in the case of the other pattern sections, central section 56 is provided with a plurality of dowel holes 63 and a plurality of bolt holes 64, which, in the cast assembled engine are aligned with the dowel holes and bolt holes of the other cast sections As seen in FIG. 15, a group of bolt holes 64 intersect ribs 59.

In addition, section 56 is provided with an air bleed hole 65, which communicates with air bleed hole 66 of the rotor sections 1. Any air which may be trappd in the water passages can pass upwardly through the bleed holes to the upper section 3 for discharge.

Figure 17:
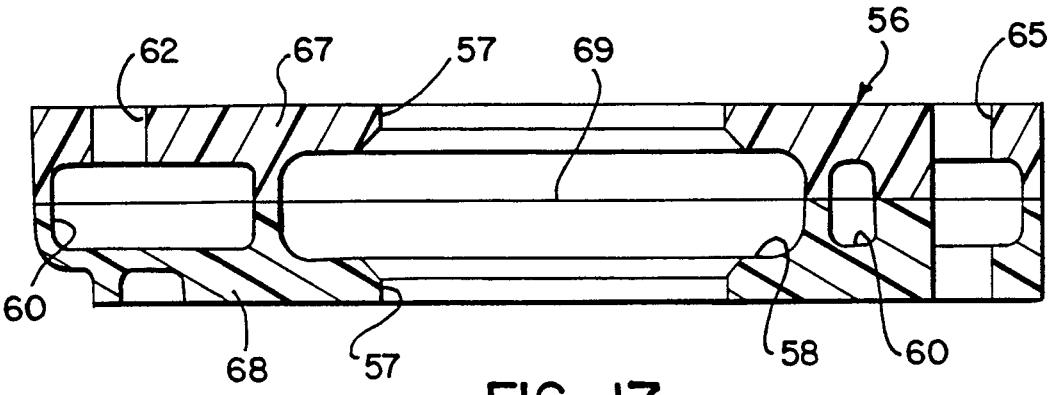
FIG. 17 is a section taken along line 17—17 of FIG. 16.

Foam pattern section 56 is formed of two components 67 and 68 which are joined by an adhesive along parting line 69. As shown in FIG. 17, parting line 69 extends normal to the axes of openings 57. The evaporable foam pattern sections of the invention enable thin sections and cavities of the rotory engine to be readily cast without the use of core supports, thereby substantially simplifying the casting operation.

As a further advantage, the dowel holes, bolt holes and water inlet and outlet ports can be formed in the casting, so that it is not necessary to subsequently drill the multiplicity of holes. Further, no facing of the bosses which surround the bolt holes is necessary, as in the conventional sand casting techniques.

The pattern sections 1–3 and 56 are designed so that all of the internal cavities can be readily readily contacted with the ceramic wash prior to the molding operation, and will readily drain from the pattern sections.

Various modes of carrying out the invention are contemplated as being within the scope of the following claims particularly pointing out and distinctly claiming the subject matter which is regarded as the invention.

We claim:

1. An evaporable foam pattern assembly for casting, comprising an end housing pattern for a rotary engine, a pattern formed of an evaporable foam polymeric material and including a central opening, said central opening having a first generally cylindrical portion and a second portion having a non-circular cross-section, said pattern also having a generally rounded relief groove connecting said portions, said pattern having an internal air passage providing communication between said second portion and the periphery of said pattern, said pattern also having an internal water chamber extending partially around said opening and having an inlet opening and an outlet opening, said pattern being composed of two components having abutting surfaces disposed along a parting line extending generally normal to the axis of said opening, said parting line extending through said relief groove, and adhesive means for joining the abutting surfaces together.

2. The pattern assembly of claim 1, in which said parting line is stepped and has an outer annular portion intersecting said water passage and said air passage and has an inner portion offset from said annular portion and intersecting said relief groove.

3. The pattern assembly of claim 1, and including a plurality of axial holes adapted to receive bolts in the metal casting.

4. The pattern assembly of claim 3, and including a plurality of second axial holes to receive dowels in the metal casting.

5. The pattern assembly of claim 1, and including a rib disposed in said air passage and dividing said air passage into a pair of passage sections.

6. The pattern assembly of claim 1, wherein one of said inlet and outlet openings extends longitudinally of the axis of said opening.

7. The pattern assembly of claim 1, wherein said second portion is generally elliptical in shape.

8. The pattern assembly of claim 7, and including a plurality of second longitudinal holes adapted to receive dowels in the assembled engine.

9. An evaporable foam pattern assembly for casting a metal rotor housing of a rotary engine, comprising a pattern formed of an evaporable polymeric material and having a central chamber of generally epitrochoidal shape, inlet opening means providing communication between the periphery of said pattern and said chamber, said inlet opening means serving to conduct fuel to said chamber in the assembled engine, outlet conduit means providing communication between the periphery of said pattern and said chamber, said outlet conduit means serving to discharge exhaust gases from said chamber in the assembled engine, said pattern having an internal water passage extending at least partially around said chamber, and having an inlet port communicating with one end of said passage and having an outlet port communicating with the opposite end of said passage, said pattern being composed of first and second components having abutting surfaces disposed along a parting line normal to the axis of said chamber, and adhesive means for joining said abutting surfaces.

10. The pattern assembly of claim 9, wherein said inlet port and outlet port extend longitudinally of the axis of said chamber.

11. The pattern assembly of claim 9, an including a plurality of first longitudinal holes adapted to receive bolts in the assembled engine.

12. The pattern assembly of claim 8, and including a well disposed in the periphery of said pattern, a portion of said water passage being divided into a pair of passage sections extending on either side of said well.

13. The pattern assembly of claim 12, wherein said pattern includes a third component bordering said well, said third component extending laterally of the axis of said chamber and the periphery of said third component abutting surfaces of said first and second components along a second parting line, and second adhesive means for joining the abutting surfaces at said second parting line.

14. The pattern assembly of claim 13, wherein said second parting line is cylindrical in shape.

15. The pattern assembly of claim 14, wherein said first and second components each have an internal groove facing said third component and defining said passage sections.

16. The pattern assembly of claim 8, wherein said pattern includes a second water passage surrounding said outlet conduit means.

17. The pattern assembly of claim 16, and including an inlet disposed in said first component and connected to said second water passage and an outlet disposed in said second component and connected to said second water passage.

18. The pattern assembly of claim 16, wherein said pattern includes a third component extending from said chamber to the periphery of said pattern, said third component defining said outlet conduit means and the outer periphery of said third component disposed in abutting relation with surfaces of said first and second components along a second parting line, and second adhesive means for joining the abutting surfaces at said second parting line.

19. The pattern assembly of claim 18, wherein the outer periphery of said third component is provided with a peripheral recess that mates with internal recesses in said first and second components to provide said second water passage.

20. The pattern assembly of claim 18, wherein said second parting line is generally cylindrical in shape.

21. An evaporable foam pattern assembly for casting the housing of a rotary engine, said assembly including a polymeric foam rotor housing pattern section and a pair of polymeric foam end housing pattern sections, said rotor housing pattern section having a central epitrochoidal chamber, inlet passage means in said rotor housing pattern section for introducing a fuel to said chamber, exhaust outlet passage means in said housing pattern section for discharging exhaust gases from said chamber, said rotor housing pattern section having an internal water passage extending at least partially around said chamber, inlet port means communicating with one end of said water passage, outlet port means communicating with the opposite end of said water passage, said rotor housing pattern section composed of two components having abutting surfaces disposed along a first parting line normal to the axis of said chamber, each end housing pattern section having a central opening with an outer portion of each central opening being cylindrical and the inner portion of each central opening being non-cylindrical, each end housing pattern section having a relief groove connecting said portions of said opening, air passage conduit means disposed in each end housing pattern section and providing communication between the exterior of said end housing pattern section and said non-cylindrical portion of said opening, said non-cylindrical portion of each end housing pattern section adapted to communicate with said chamber in said rotor housing pattern section to distribute air through said chamber, each end housing pattern section having an internal water chamber extending partially around the respective central opening, each end housing pattern section having inlet opening means communicating with one end of the water chamber and having water outlet conduit means communicating with the opposite end of said water chamber for discharging water from said chamber, each of said end housing pattern sections being composed of two components having abutting surfaces disposed along a parting second line normal to the axis of the respective central opening, said second parting line extending through the relief groove of the respective end housing pattern sections, and adhesive means for joining said abutting surfaces at said first and second parting lines.

22. The pattern assembly of claim 21, wherein said non-circular portion is generally elliptical in shape.

23. The assembly of claim 21, wherein said rotor housing pattern section is provided with a second water passage surrounding said exhaust outlet passage means.

24. The assembly of claim 23, wherein said rotor housing pattern section is provided with a first aperture establishing communication between the periphery of said rotor housing pattern section and said second water passage and a second aperture establishing communication between said second water passage and a transverse face of said rotor housing pattern section.

25. The assembly of claim 21, and including a pair of rotor housing pattern sections, and a central pattern section disposed between said rotor housing pattern sections, said central housing pattern section having a central opening adapted to communicate with the chambers of said rotor housing pattern sections, air passage means providing communication between said central opening and the periphery of said central section, and water passage means extending at least partially around said central opening, inlet means communicating with one end of said water passage means and outlet means communicating with the opposite end of said water passage means, said inlet and outlet water passage means extending longitudinally of the axis of said central opening.

26. The assembly of claim 25, and including a plurality of ribs disposed within said air passage means and dividing said air passage means into a plurality of air passage sections.

27. The assembly of claim 26, wherein said central section is provided with a plurality of longitudinally extending holes extending therethrough, at least one of said holes intersecting one of said ribs.

* * * * *